United States Patent [19]

Brenning, Jr.

[11] 4,131,952

[45] Jan. 2, 1979

[54] SAFETY GLOVE

[76] Inventor: Frederick K. Brenning, Jr., 310-1/2 Prospect St., Wellington, Ohio 44090

[21] Appl. No.: 833,088

[22] Filed: Sep. 14, 1977

[51] Int. Cl.[2] ..... A41D 13/00; A41D 13/10

[52] U.S. Cl. ..... 2/2 R; 2/16; 2/21; 2/70; 2/124; 2/126; 2/161 R; 2/163

[58] Field of Search ..... 2/16, 21, 159, 161 R, 2/161 A, 163, 168, 270, 2, 126, 119, 70, 124, 333

[56] References Cited

U.S. PATENT DOCUMENTS

| | | | |
|---|---|---|---|
| 612,741 | 10/1898 | Longden | 2/168 |
| 747,730 | 12/1903 | Kommer | 2/163 |
| 1,265,124 | 5/1918 | Shumaker | 2/163 X |
| 1,358,824 | 11/1920 | Burden | 2/163 |
| 1,620,434 | 3/1927 | Burden | 2/163 |
| 4,045,824 | 9/1977 | Weppler | 2/163 |
| 3,009,1164 | 11/1961 | Frey | 2/270 |

FOREIGN PATENT DOCUMENTS

| | | | |
|---|---|---|---|
| 11427 | 3/1910 | United Kingdom | 2/126 |

*Primary Examiner*—Werner H. Schroeder
*Assistant Examiner*—Moshe I. Cohen
*Attorney, Agent, or Firm*—Watts, Hoffmann, Fisher & Heinke Co.

[57] ABSTRACT

A safety glove for a workman is shown having a fingerless body portion for covering the palm and top of the hand, and attached finger and thumb as well as palm and top hand covering portions that can be easily separated from the main body portion by a pulling motion exerted lengthwise or otherwise along any one of the separable portions, which pulling motion would be produced, for example, when the top end of one or more of these finger portions or top hand sections is caught in a machine or snagged by a drill bit and the workman, with a reflex action, pulls his hand in an opposite direction. The instantaneous separation of the finger, thumb, palm or top hand covering portions from the main glove body portion prevents the entire gloved hand from being pulled into the machine and thus permits the workman to remove his hand from the danger zone.

19 Claims, 10 Drawing Figures

SAFETY GLOVE

BACKGROUND

In the performance of various industrial operations, workmen must sometimes wear gloves to protect their hands from abrasion, corrosive chemicals, electrical shock, heat and other dangers where direct contact with the skin would otherwise cause harm. Many situations arise where the gloved hand must be used in and around machinery and, unfortunately, painful and crippling injuries have been caused in the past when the tip end of a finger or thumb portion or palm or top hand section of a glove is caught by a moving machine element and the pulling action carries the finger and its covering and the attached portion of the glove covering the hand into the machine. This has always been a more or less serious problem for workmen, especially when the material being worked upon must be manually guided to be fed between machine elements such as wringer rolls where the tip end of one of the finger or thumb portions of the glove might fall into the bight of the rollers. Such glove-caused accidents seem to be more prevalent with machines such as rollers, shears, punch presses, wringers, crimping, drilling, milling, bending and others in which similar operations are performed.

Frequently it is necessary in the chemical and electrical arts, to provide gloves that give insulation against heat and electrical shocks and from reactions with chemical agents. Workmen in these shops may be required to wear such gloves that simultaneously protect the user against the chemical reaction and electrical shocks as well as from machine caused accidents.

Various proposals have been made for the construction of protective gloves for use around machinery as exemplified in the U.S. Pat. Nos. 2,686,316 to Linn, 2,923,946 to Nielson, 3,290,695 to Burtoff, 3,184,756 to DeLuca, Jr., 3,386,104 to Casey, and 3,732,575 to Pakulak. All of these disclosures propose to solve the accident and damage control problem by providing armor within the glove structure to protect the area apt to be damaged, from contact with the machinery.

These disclosures all basically include a conventional glove having a body portion with integral finger and thumb covering portions that have protection built into the gloves to preclude the machine parts from reaching the fingers or other parts of the hand even though the glove with the fingers and palm of the hand has been pulled into a position between the moving parts of the machine. The finger portions are not made to be separated from the main body of the glove.

Separable finger portions attached to a glove are not shown in the above, but separable wear shields that provide a separate covering adapted to be worn over the finger and thumb portions of a conventional glove are shown in prior U.S. Pat. Nos. 1,358,823, 1,358,824 and 1,620,444, all issued to Burden. All of these patented disclosures provide gloves adapted to be used to protect the palm and fingers of the hand until the finger or thumb portions become substantially worn. The Burden constructions all provide finger portion covering means adapted to be fitted over these worn finger portions to prolong the use of the entire glove means. The attaching loops on the stalls described provide for more or less permanent installation of these cover elements on the finger portions of the basic glove structure until the stalls themselves become worn enough to require replacement. The permanently attached finger portions of the Burden gloves are always present either alone or with their covering sheaths.

The prior art known to the inventor also includes U.S. Pat. No. 2,649,587 to Swearingen that provides an apron mounted on a spring frame that is adapted to support the apron on a workman's body. The spring frame normally supports the bib and apron in front of the workman but should the apron catch on fire or be engaged in a machine, the apron and its associated spring support may be removed in a fraction of a second since there are no strings to untie. The entire garment, together with the spring support, is stripped from the wearing when an emergency arises.

BRIEF DESCRIPTION

The glove of this invention includes a fingerless body portion having a front surface for covering the palm and a top surface for covering the back of the hand. This body has suitable apertures positioned properly around its periphery to permit the body to be drawn over the palm and back of the hand of the wearer to encircle the wrist and permit the fingers and thumb to protrude therefrom through the apertures. Finger and thumb covering portions are provided for completing the glove, these portions being separably attached to the body portion to cover and provide normal industrial protection for the fingers and thumb. The separable finger and thumb covering portions are normally carried on the glove body to form a complete glove structure but any one of the finger or thumb covering portions supported on the body can be easily separated therefrom by pulling the body and finger or thumb covering portion in opposite directions. In one embodiment of this invention palm and top hand portions are also separable in a manner similar to the finger and thumb portions.

The joint between the finger and thumb covering and the body portions of each glove is designed to be ruptured with a pull directed along the length of the finger and thumb portions, and the joint between the palm and top hand portions and the remaining body portion is designed to be ruptured by a pull in a direction across the joint, so that these separable coverings can be separated from the body and pulled away from the hand without producing an irresistible pull such as would drag the body portion into the machine.

Various forms of rupturable joints can be provided to join the finger and thumb coverings or palm and top hand portions to the body of the glove; for example, in some situations a low tensil strength band or low strength connecting thread or network of woven threads or other weakened tear line at this junction will be effective. In other embodiments a ring or bead is pressed into a cooperating channel or groove to provide a connection and seal that can be pulled apart. This construction is especially effective with molded gloves. The joints between the finger and thumb portions and the body portion are designed to separate when a pull is exerted along any such finger or thumb portion, as when it is caught in a machine. The separation of the covering minimizes the possibility that the body of the glove will be pulled into the machine when only the tip end of a finger portion, or a portion of the back or palm section, for example, becomes engaged in the bight of a pair of wringer rolls, or caught by a milling cutter or a drilling bit.

The same structure as provided herein to allow ready separation of glove parts can be adapted to garments other than gloves to provide an analogores safety feature.

The invention will be more fully understood from the more detailed description below which refers to the structure illustrated in the accompanying drawings in which.

DETAILED DESCRIPTION

Figure 1:
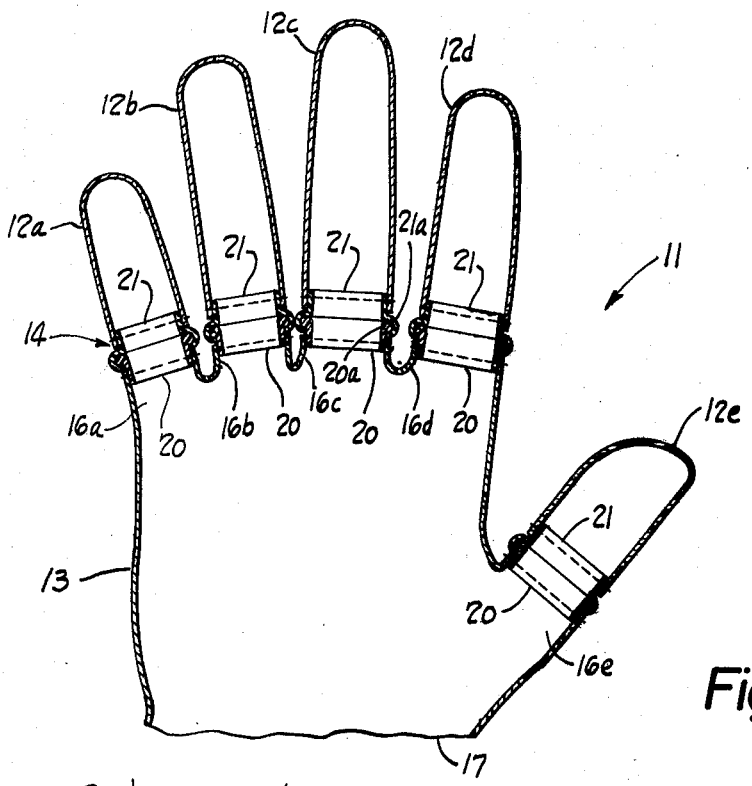
FIG. 1 is a front elevation, partly in section, looking at the palm of a right hand glove that illustrates one embodiment of the invention.

Referring to FIG. 1, a glove 11 is shown illustrative of the general arrangement by which separable finger portions 12*a–e* and a body portion 13 is provided using connections or joint means 14, which may take either the form shown in FIG. 1 or the forms shown in FIGS. 2 to 10. As shown, the main body portion 13 provides a fingerless covering for the palm and back of the hand. This body portion may be constructed in any conventional form, as by stitching several palm and top elements along side seams and at the areas near the knuckle joints of all the fingers and thumb, or a one piece molded plastic or rubber body portion may be formed having the required palm and top covering with apertures for the wrist and digits.

The periphery of the body portion has apertures 16*a–e* through which the fingers and thumb of the hand may pass and an aperture 17 for the fitting around the wrist. The style of the body may be designed for any special use and may have more or less of a gaunlet for guarding the wrist, depending upon the industry in which the wearer of the glove is engaged.

The palm and back elements of the body portion 13 may be made of any conventional flexible wear resistant material. The finger and thumb coverings 12*a–e* supported on the body may be either stitched, bonded, or molded elements and when attached to the body portions form a complete glove that provides the desired protection for the worker, as with a conventional glove. The finger and thumb covering of this glove, however, are separable from the body under certain circumstances, to preclude the possibility that the workman's hand will be drawn into a machine.

The details of the finger and thumb coverings 12*a–e*, are shown in FIG. 1, these coverings being adapted to fit over these digits to provide a safety factor. The separable finger and thumb portions have an internal diameter to easily slide over digits and are joined to the body portion in a manner to permit them to be separated from the body when a pulling force is exerted in a direction relatively along the length of a finger or thumb covering. The joint structure 14 is designed to rupture freely in the case of an accident without producing an irresistible pull on the hand fitted into the glove, thus permitting the finger or thumb covering to be pulled off of the finger without producing a pull on the body portion of the glove that might pull the hand into engagement with the machine when the workman allows his hand to get too close to a moving machine part. Thus, for example, if the freely extending tip end of a portion 12*a–e*, of the glove should get caught in the bight of a pair of wringer rolls, the natural reflex action of the workman causes him to pull his hand quickly in the opposite direction while the digit covering portion is pulled free from the body portion and slips longitudinally off of the digit and the hand is immediately withdrawn to a safe position.

The joint structure 14 that makes separation of the finger and thumb portions possible is connected at the apertures 16 on the periphery of the body portion 13. Several different embodiments of such structure are contemplated.

FIG. 1 shows plastic rings 20 each with a bead portion 20*a* sewn to the body portion 13, and plastic rings 21 each with a groove 21*a* sewn to each finger and thumb portion 12. The grooves 21*a* open inwardly of the rings 21 and resiliently snap over the respective beads. In the case of rubber or plastic gloves, the beads and grooves can be integrally molded with the respective body portion and finger and thumb portions or can be separate parts incorporated during the molding process to become an integral part.

Figure 3:
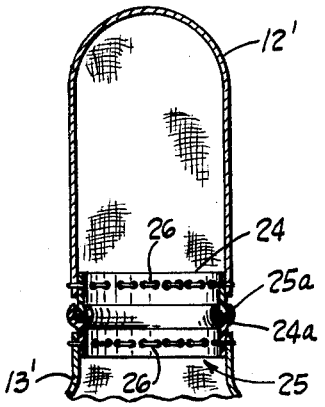
FIG. 3 is a sectional view of an O-ring or beaded joint taken on line 3—3 of FIG. 2.
Figure 4:
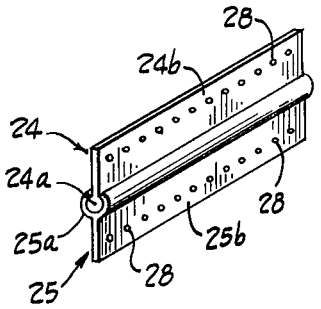
FIG. 4 is a partial perspective view of the joint-forming strip shown in FIG. 3.

Another joint structure utilizing a bead and groove is shown in FIGS. 3 and 4, in which a resilient O-ring or bead 24*a* of a ring 24 is received within a resilient groove 25*a* of a ring 25, the rings being either integral with the open ends of each of the finger and thumb coverings 12*a–e'* and body portion 13', respectively, or permanently attached thereto by stitching 26 (as shown) or by other suitable means, such as adhesive. The O-rings or beads 25*a* have a frictional snap fit in the grooves 24*a* and form a relatively tight seal. The rings 24, 25 are of a size to easily fit over each of the knuckle joints of the respective digits and the rings 24 can slide off easily when a covering is torn from the body portion 13' by engagement of a finger or thumb portion 12' with a machine part.

The rings 24, 25 can be molded integrally with their respective finger, thumb and body portions of the glove when a rubber or synthetic resin glove material or the like is used that can be so formed. Rubber, nylon and other plastic materials provide materials for making gloves that are wear resistant, have good electrical insulating properties and are resistant to many corrosive chemicals. Finger and thumb covering portions having integral beads 24*a* can be separably supported by a tight snap engagement within the somewhat resilient walls of integral grooves 25*a* molded into the body portion of a glove.

Figure 2:
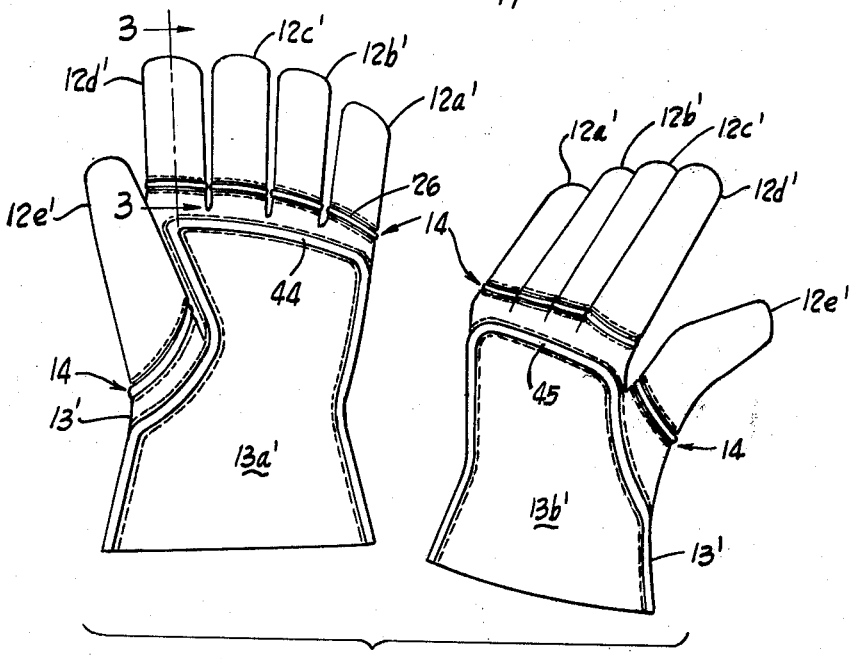
FIG. 2 is a perspective view of the back and front of a left hand glove showing a second embodiment of the invention.

When the body 13 of the glove and the coverings 12 are made of woven materials or constructed of leather, as shown in FIGS. 1–3, the rings 20, 21 or 24, 25 can be molded of rubber or resin with integral supporting edges, such as the edges 24*b*, 25*b* shown in FIG. 4. Each edge may be provided with a series of apertures 28 to receive stitches to hold the rings on the respective woven finger, thumb and body portions. If the material will bond properly, the edges 24*b*, 25*b* can be adhesively mounted on their respective finger, thumb and body portions. As illustrated in FIG. 4, the rings 24, 25 are made as flexible strips and then formed into a circular configuration. Alternatively, the rings can be molded in a circular shape without any juncture, which results where opposite ends of the strips meet.

The O-ring or bead and groove break-apart means for joining the finger and thumb portions to the body portion have a tensile characteristic such that the O-ring or bead separates from the groove with a very low pulling effort. The joint breaks cleanly with no undue pulling action being needed to effect the separation of the engaged parts. However, the assembled joint is quite satisfactory for holding the finger and thumb portions in assembled relation on the body portion during all normal use of the assembled finger, thumb and body portions during the workman's usual manual activities. The O-ring or bead and groove does provide a very serviceable break-away joint for this glove that yields only when a tensile pull is exerted lengthwise of a digit to separate the covering from the body of the glove.

Figure 5:
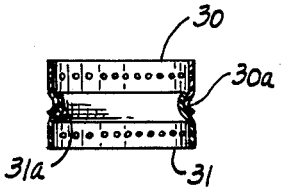
FIGS. 5 and 6 are section and partial perspective views of an alternate form of joint.
Figure 6:
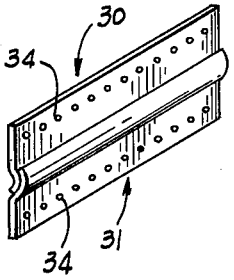

Other firmly supporting but easily detachable joining means 14 for separably attaching the finger and thumb coverings 12 to the body portion 13, are shown in FIGS. 5 through 10. In FIGS. 5 and 6, a generally resilient ring member 30 is provided that has a snap fit in a receiving ring member 31. The ring members can be molded integrally with the respective finger, thumb and body portions or they can be separate strips as shown with stitching holes 34 for attachment to woven glove material, or can be adhesively attached. They can also be formed initially in ring form rather than strips. A ridge portion 30*a* is received in a groove-forming portion 31*a* with a snap fit, and the rings are designed to be easily separated with a longitudinal pull along a finger or thumb portion to separate the pulled portion from the body portion so that the covering can be slipped from the digit.

Figure 7:
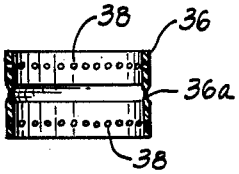
FIGS. 7 and 8 are section and partial perspective views of another form of joint.
Figure 8:
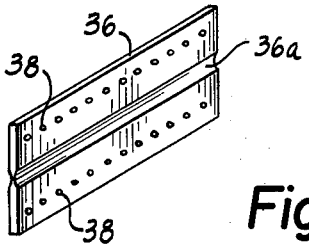

FIGS. 7 and 8 show a molded plastic strip 36 provided holes 38 along opposite edges for stitching to a woven glove. Alternatively, the edges may be adhesively bonded. The plastic strip 36 has a thinned-out center section 36*a* that is weaker than other portions and can be further weakened by crimping or perforating to form a tear line to provide for easy separation of the pulled finger or thumb covering. The strip 36 can be molded in the form of a ring or the thinner section 36*a* can be integrally incorporated into a molded glove and subsequently weakened.

Figure 9:
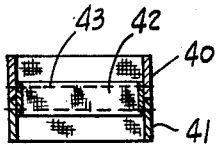
FIGS. 9 and 10 show section and partial perspective views of a woven cloth strip adapted to serve as a joint for connecting the finger, thumb and body portions of the glove together.
Figure 10:
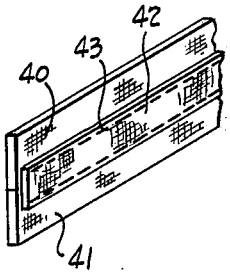

A particularly desirable construction of a separable joint or juncture between finger and thumb portions 12 and a body portion 13 for use with cloth gloves is shown in FIGS. 9 and 10. Two cloth strips 40, 41 are shown joined by a network of low tensile strength strands (i.e., a knitted or woven fabric) 42 interwoven or, as shown, sewn between the two strips with stitches 43. When the weakened strands are interwoven the two strips become integral with the weakened strands without a clear juncture. The strands 42 are of a tensile strength less than that of the strips. The low tensil strength may be obtained by initially selecting a weak strand or strands or by chemically treating the network, as with weak acid or strong bleach, in which case the desired strength is achieved by the extent or time of treatment. The strips 40, 41 are each constructed to be sewn, one to a finger or thumb part 12 and the other about an aperture 16 of a glove body portion 13, to form a ring joint or juncture 14. When a finger or thumb portion is subjected to longitudinal pull of a predetermined magnitude, the network of strands 42 will break and the finger or thumb portion will separate from the body at the juncture between the two strips. It is also contemplated that the network of low tensile strength strands 42 be directly sewn to the finger and body portions of the glove, eliminating the need for the strips 40, 41. This is preferable from the stand point of avoiding extra pieces 40, 41, but use of such prefabricated strips to incorporate a weakened network of strands joining the finger and thumb portions to a glove body has the advantage of a pre-established strength and relationship between the network and the two strips 40, 41. A glove manufacturer can merely purchase the strips and incorporate them into any glove being manufactured and be assured of proper safety performance. The two strips themselves should be as thick and strong as the glove material, so that the glove does not have a band of thin and inadequate protection at the base of each finger, which might subject the wearer to abrasion or result in loss of insulating protection. A particular advantage in interweaving the weakened strands 42 into the material of the strips 40, 41 rather than sewing them onto the strips, is the absence of any protruding edge (i.e., the thickness of the strips is uniform across the entire width). A particular advantage of the network of low tensile strength strands is the inherent flexibility of the material and the ease with which it may be sewn into place. In addition, if desired, the strips or network can be adhesively bonded to the glove body and finger and thumb covering portions rather than sewn.

Where it is desired to avoid the operation of sewing or bonding separate strips 40, 41 to a glove, it is possible with some fabrics to establish a weakened network of strands by chemically treating a narrow band of the glove fabric itself in a way that weakens the strands of the existing fabric, as by use of a weak acid or strong bleach in a circumferential zone at the base of each finger and thumb portion. This technique can be used to facilitate separating palm or back portions of the glove as well.

In some instances, it is desirable to have a palm section or the back covering of the glove separably attached to the body portion. As shown in FIG. 2, the front 13*a*′ and back 13*b*′ of the glove are attached to the body portion 13′ with joint structure 44, 45 specifically of the construction illustrated in FIGS. 9 and 10. In this form of the invention, if the back surface of the glove should become engaged with a moving machine part (for example, turning drill bits or milling bits), the back would be pulled free from covering the hand without pulling the hand into a danger area. Similarly, the palm portion of the glove can be made separable to prevent injury to the workman when the front surface of the glove becomes entangled with a machine element. The joint structure shown in FIGS. 7 and 8 can also be used for attaching the palm and back surfaces 13*a*′, 13*b*′ of the glove to the body portion 13′. The joints can be formed integrally, or can be adhesively attached or stitched onto the body.

The glove structure described above, including all of the several modifications, are made to have the normal feel and flexibility of a conventional workman's glove. The materials can be selected from those that have been proven most useful in any given industrial activity and with the provision of the separable finger and thumb covering portions described above, the workmen in all fields can enjoy the substantial freedom from crippling and deforming accidents such as those caused in the past when a glove worn by the workman becomes engaged in the bight of a pair of rollers and pulls the workman's hand into the machine before it can be extracted from the glove. With the herein described glove, should the tip of a finger or thumb covering or the back of a glove or the palm, become entangled with a machine part, that portion of the glove will tear away and pull free while the workman's reflex action causes him to withdraw his hand, thus minimizing the possibility that his hand will be dragged into the machine by entanglement with his gloved hand to be twisted, mangled, or broken or spraining of the wrist. The back and palm portion of the glove may be adapted to be pulled away or the finger and thumb covering portions may be pulled longitudinally off of these digits to avoid involving the hand or fingers in an accident. With this glove structure, the safety margin in connection with the use of industrial gloves, is greatly increased.

These gloves are suggested for industrial as well as any other use where moving machine parts or other activities are pursued in situations such that fingers might be drawn into a dangerous area to be pinched, crushed or severed. The separable finger, thumb, back and palm pieces of the glove give the workman a split second after his natural reflexive actions have been activated, to pull his hand away from the potential danger area leaving only the torn away portion of the glove in the machine.

Gloves within the scope of this invention may be made of materials to be fluid tight and to have heat or electrical insulating properties. The gloves can be made acid and wear resistant as well as resistant to other corrosive chemicals whereby the needs of workmen in all industries in which such gloves are now found to be of service, can be more safely satisfied with the improved glove described above. It is possible that modification thereof may occur to those skilled in the art that will fall within the scope of the following claims.

What is claimed is:

1. A safety garment comprising:
(a) a first portion for covering at least a part of a body,
(b) a second portion for covering an additional part of the body and separable from the first portion, and
(c) means, including strands of substantially lower tensile strength than said portions, in the form of a separate fabric sewn or bonded to said first and second portions, joining said separable portions to permit separation at said means when the portions are pulled in opposite directions across said means.

2. A garment as in claim 1 wherein said fabric includes first and second fabric strips connected to the first and second portions of the garment, and a third fabric strip joining the first and second strips.

3. A garment as in claim 1 where the first portion is a palm-covering part of a glove and the second portion is a finger-covering part of a glove.

4. A safety glove comprising:
(a) a first portion for covering a back part of the hand,
(b) a second portion for covering a palm part of the hand, and
(c) means separably joining said first and second portions, said means including strands of substantially lower tensile strength than said portions, in the form of a separate fabric sewn or bonded to said first and second portions, joining said separable portions to permit separation at said means when the portions are pulled in opposite directions across said means.

5. A garment as in claim 4 wherein said fabric includes first and second fabric strips connected to the first and second portions of the garment, and a third fabric strip joining the first and second strips.

6. A safety glove having a body portion, at least one digit-covering portion, and means releasably connecting each digit-covering portion to the body portion; said means comprising two rings, means securely connecting one ring to a digit-covering portion and the other to the body portion, and strand means circumferentially interconnecting the rings; said strand means having a tensile strength less than that of the rings and the means connecting the bands to the digit-covering and body portions.

7. A safety glove as in claim 6 wherein said rings are fabric, said strand means is threads that join the rings circumferentially, and said means connecting the rings to the digit-covering and body portions is stitching.

8. A safety glove comprising:
(a) a body portion for covering a hand,
(b) finger and thumb portions into which digits of a hand can extend,
(c) said portions being made of fabric, and
(d) a band of weakened fabric about each finger and thumb portion,
(e) said band being formed by chemically treating the fabric in a limited area defining said circumferential band to weaken the fabric in said area.

9. A safety glove as set forth in claim 8 wherein the chemical treating includes the application of strong bleach to said area.

10. A safety glove comprising:
(a) a body portion for covering at least a portion of the hand and having apertures through which fingers and thumb can extend,
(b) a plurality of individually separable portions joined to said body portion to complete the glove, and
(c) means joining said separable portions to said body portion to permit separation in response to a pulling action on said separable portions in a direction away from said body portion while the body portion is restrained from moving in the direction of the pulling action, said means including a weakened tear line between said separable portions and said body portion.

11. A glove as in claim 10 wherein said means to join said separable portions to said body portion takes the form of a plurality of plastic cylindrical ring means integral with finger, thumb and body portions, and each of said ring means has a weakened section disposed substantially centrally and circumferentially thereof.

12. A safety glove as set forth in claim 10 wherein the said portions are formed of a fabric and said means is a chemically treated band of said fabric weaker than remaining portions of the fabric.

13. A glove as in claim 10 wherein finger and thumb portions are separable from the body portion and the means joining said separable finger and thumb portions to the body portion are a plurality of plastic cylindrical rings adapted to freely slide over the fingers and thumb elements of a person putting on the glove, said rings each having one edge attached to the respective finger and thumb portions of said glove and another edge attached to the body portion around one of said finger and thumb apertures, each of said rings having a weakened section disposed substantially centrally thereof between said edges.

14. A glove as in claim 13 wherein each of said plastic cylindrical rings has a series of apertures formed therein adjacent edges thereof for receiving stitches to hold said rings on the respective finger and thumb and the body portions.

15. A safety glove comprising:

(a) a body portion for covering at least a portion of the hand and having apertures through which fingers and thumb can extend, (b) a plurality of individually separable portions joined to said body portion to complete the glove, and (c) means joining said separable portions to said body portion to permit separation in response to a pulling action on said separable portions in a direction away from said body portion while the body portion is restrained from moving in the direction of the pulling action, said means including a fabric strip having zones along opposite edges for attachment to a separable portion and the body portion, said zones each having acceptable wear and tear qualities and said strips each having a central zone between said edge zones which has a lower tensile strength than the edge zones.

16. A glove as in claim 15 wherein said gloves are made of a woven fabric and said strips are attached to said respective portions with stitching along each of the edge zones thereof.

17. A glove as in claim 15 wherein said strips are attached to said respective portions with adhesive along each of the edge zones thereof.

18. A glove as in claim 15 wherein each strip is formed of two pieces joined at the central zone by a strand or strands having said lower tensile strength.

19. A safety glove comprising:

(a) a first portion for covering a back part of the hand, (b) a second portion for covering a palm part of the hand, and (c) means separably joining said first and second portions, said means including one or more strands of substantially lower tensile strength than said portions, joining said separable portions to permit separation at said means when the portions are pulled in opposite directions across said means, (d) said strands of lower tensile strength being part of the glove fabric chemically treated to reduce their strength.

* * * * *